United States Patent [19]

Shimek et al.

[11] Patent Number: 5,000,162

[45] Date of Patent: Mar. 19, 1991

[54] CLEAN BURNING GLOWING EMBER AND GAS LOG BURNER SYSTEM

[76] Inventors: Ronald J. Shimek, 8944 W. 154 St., Prior Lake, Minn. 55372; Daniel C. Shimek, 5260 W. 132nd St., Apple Valley, Minn. 55124; James F. Wolf, 6168 Marlen Cir., Prior Lake, Minn. 55032

[21] Appl. No.: 515,707

[22] Filed: Apr. 27, 1990

[51] Int. Cl.[5] ..... F24C 3/00

[52] U.S. Cl. ..... 126/512; 126/92 R; 126/523; 431/125

[58] Field of Search ..... 126/92 R, 502, 503, 126/512, 85 R, 85 B, 92 AC, 307 R, 500, 92 B, 523, 531; 431/125, 110, 112, 328, 329

[56] References Cited

U.S. PATENT DOCUMENTS 3,277,882 10/1966 Rose ..... 126/512
3,382,861 5/1968 Peterson ..... 126/512
4,793,322 12/1988 Shimek et al. ..... 126/512
4,828,485 5/1989 Jankowski ..... 126/92 R
4,875,464 10/1989 Shimek et al. ..... 126/92 R

*Primary Examiner*—James C. Yeung
*Attorney, Agent, or Firm*—John B. Sowellatt

[57] ABSTRACT

An efficient low carbon monoxide burner system for decorative gas logs is further provided with one or more pipe branches which provide glowing embers in front of and/or on the bottom of decorative gas logs placed over the gas log burner system. The pipe branch which provides the glowing embers is provided with decorative ember flame holes which are arranged directly juxtaposed expanded fire resistant material which is heated so as to form a glow material for producing glowing decorative ember flames in front of or at the bottom of the decorative logs in a manner which produces low carbon monoxide. The pipe branch for providing decorative flames between logs is provided with nozzles for directing the flames away from the logs.

20 Claims, 5 Drawing Sheets

CLEAN BURNING GLOWING EMBER AND GAS LOG BURNER SYSTEM

BACKGROUND OF THE INVENTION

1. Related Applications

This application is an improvement of our U.S. Pat. No. 4,875,464, issued 24 October 1989 for a "Clean Burning Gas Log Burner System".

2. Field of the Invention

The present invention relates to efficient gas burners for burning natural gas, manufactured gas and propane gaseous fuels. More particularly, the present invention relates to an efficient burner system for burning gaseous fuels in a manner which provides decorative flames and decorative embers which simulate wood burning.

3. Description of the Prior Art

Gas logs are usually made of a fire resistant ceramic material as is well known. Heretofore when a gas burner system was employed below such prior art decorative gas logs, the gas flame that was directed against the gas logs was cooled so as to produce a highly inefficient and dirty yellow flame. In our U.S. Pat. No. 4,875,464 there is shown and described a highly efficient gas burner system wherein the flame from the gas burner is isolated and directed away from impinging on the gas logs which act as a heat damper or heat sink, thus, creating excessive soot and carbon monoxide (CO). In the preferred embodiment of this prior art invention an inverted U shaped shield is mounted over the gas burner and provided with horizontal openings in the U shaped shield so as to guide and deflect the gas flames away from the decorative gas logs and to produce a clean burning gas log burner system.

Heretofore it was known that gas burners or gas nozzles could be buried below a level of sand or vermiculite. These burner systems were heretofore referred to as sand pan burners which dispersed the gases through the fireproof material and permitted the gas permeating through the porous material to ignite upon entering the atmosphere so as to present an orange or yellow dispersed flame over a large area or bed of material. As will be explained in more detail hereinafter expanded fireproof material has been sprinkled over the sand pan devices so that the gas burning over the dispersed area burns through the added expanded fireproof material and produces an orange color flame in the expanded fireproof material which simulated to some extent hot ashes in a fireplace. These prior art sand pan burners are known to produce carbon monoxide levels in excess of 200 parts per million (ppm) and excessive amounts of carbon and soot.

Presently the American National Standards Institute (ANSI) Emission and Safety Standards Z-21.50 (1986), which has been adopted by the American Gas Institute, only permits 200 parts per million carbon monoxide when burning natural gas or liquified petroleum fuels. Accordingly, the prior sand pan devices have exceeded the accepted levels of the American National Standards Institute and the American Gas Institute, thus, creating a pollution problem which has resulted in some manufacturers attempting to modify the standard so as to increase the pollution in the atmosphere.

When the prior art burner systems for artificial decorative logs and sand pan type burners are incorporated into pre-fabricated fireplaces or existing masonry fireplaces, they must meet the ANSI emission standards which have been adapted by the American Gas Institute. Accordingly, it would be desirable to provide a clean burning gas burner system for glowing embers and for gas logs which meet the present ANSI emission standards.

There is a present and long felt need for such gas log and glowing ember burner systems which will burn clean and which very closely simulate the natural flames produced by burning wood logs. Therefore it is desirable to produce a reliable and efficient gas log and glowing ember burner system which produces the desirable yellow and orange decorative flames that closely simulate burning wood logs and which provide efficient usable heat and still meets the EPA regulations and the ANSI emissions and safety standards.

SUMMARY OF THE INVENTION

It is a primary object of the present invention to provide a highly efficient gas burner system for use with artificial, decorative logs and glowing ember devices.

It is another primary object of the present invention to provide a novel burner system which closely simulates the flames and embers of natural wood logs burning.

It is another principal object of the present invention to provide a prefabricated assembled gas burner system which is American Gas Association design certified and which maintains its factory set emissions standards after installation.

It is another principle object of the present invention to provide a novel burner system which has low carbon monoxide (CO) emission characteristics.

It is yet another object of the present invention to provide an efficient low CO emission burner system that combines long decorative gas flames with short or low smoldering glowing embers in the same burner system.

It is another object of the present invention to provide a log burner system combined with an ember burning system for use with fireplaces having one or more sealed glass sides in combination with a source of outside combustion air.

It is yet another object of the present invention to provide an efficient heat exchanger for use with a novel burner system for heating room air.

It is another object of the present invention to provide a blower system placed inside of a heat exchanger fireplace system for forced air circulation of room air to be heated.

It is another object of the present invention to provide a controllable gas valve inside of a heat exchanger system which is cooled by the circulating room air which is to be heated.

It is another object of the present invention to provide a gas valve in a heat exchanger system which is connected to a remote sensor and to a thermostat in the heat exchanger for controlling gas supplied to the burner system as well as controlling heat to a room being heated.

It is another object of the present invention to provide a remote controlled sender for use with a remote control sensor and wherein the control sender is provided with a thermostat which in turn controls the gas supplied to the burner system so as to control the heat being supplied to a room being heated.

According to these and other objects of the present invention there is provided an efficient gas log burner system which is combined with an efficient gas burning glowing ember system. The gas burner system is provided with a plurality of burner pipe branches at least one of the turner pipe branches is mounted below decorative gas logs and provides a gas flame which projects above the gas logs without impinging on the gas logs and at least one other burner pipe branch is connected to the gas log burner branch and is arranged in front of the decorative gas logs on one or more sides so as to provide decorative ember flames on the sides of the burner which are exposed to view. The decorative ember burner comprises glow material arranged juxtaposed holes in the burner pipe branch which produce hot gas flames that embrace the glow material and cause a glowing decorative ember flame in front of the decorative gas logs which have low carbon monoxide emission.

DESCRIPTION OF THE PREFERRED EMBODIMENTS

Figure 1:
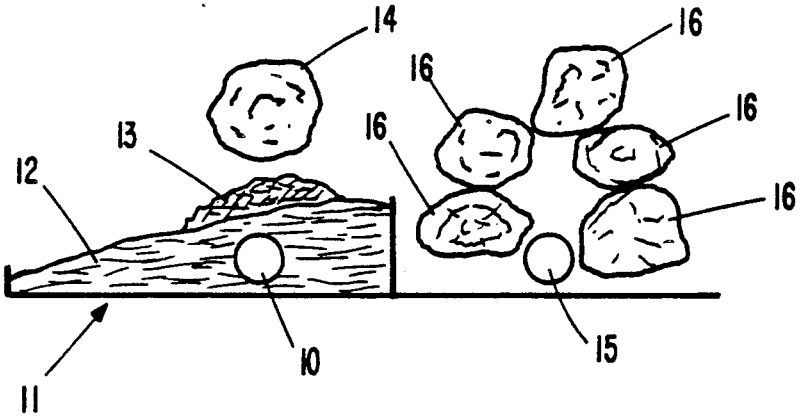
FIG. 1 (PRIOR ART)
FIG. 1 is a schematic drawing in cross-section of a combination of prior art logs and a prior art sand pan device.

Refer now to FIG. 1 showing a schematic diagram in cross-section of a prior art burner system for logs and a prior burner system for a sand pan device which have been combined for discussion purposes. A first burner system 10 is shown mounted in a box or tray 11 and covered by fire resistant material 12 such as sand or vermiculite. Dispersed on top of the sand 12 is a fire resistant material such as rock wool or mineral wool 13. A log 14 is shown suspended above the rock wool 13 and is lightly heated by the burned gases from the burner system 10 which migrate through the sand and is dispersed over a large area so as to burn as it emerges from the rock wool 13. This prior art "sand pan" burner system has been tested and found to generate high amounts of carbon monoxide that have been measured in excess of 400 parts per million (ppm). Not only does the prior art sand pan produce excessive CO levels but this burner system also generates large amounts of soot and carbon which deposits on the gas log 14 and enters the atmosphere. A separate and distinct log burner system 15 is schematically shown having a burner 15 surrounded by and covered by logs 16 made from fire resistant material such as clays or ceramic materials. When the flame from the burner 15 impinges on the artificial logs 16, the logs act as a heat sink and rapidly cools the flame before complete and proper combustion has taken place. This type of prior art system produces excessive amounts of carbon monoxide as well as soot and free carbon as explained hereinbefore.

In our U.S. Pat. No. 4,875,464 mentioned hereinbefore there is provided a gas burner system which avoids such inefficient burning and produces very low carbon monoxide gases. The system in our prior art patent employed gas shields preferably made from thin sheet metal material which when properly heated promoted and permitted the propagation of long yellow or orange flames with low carbon monoxide emissions.

Figure 2:
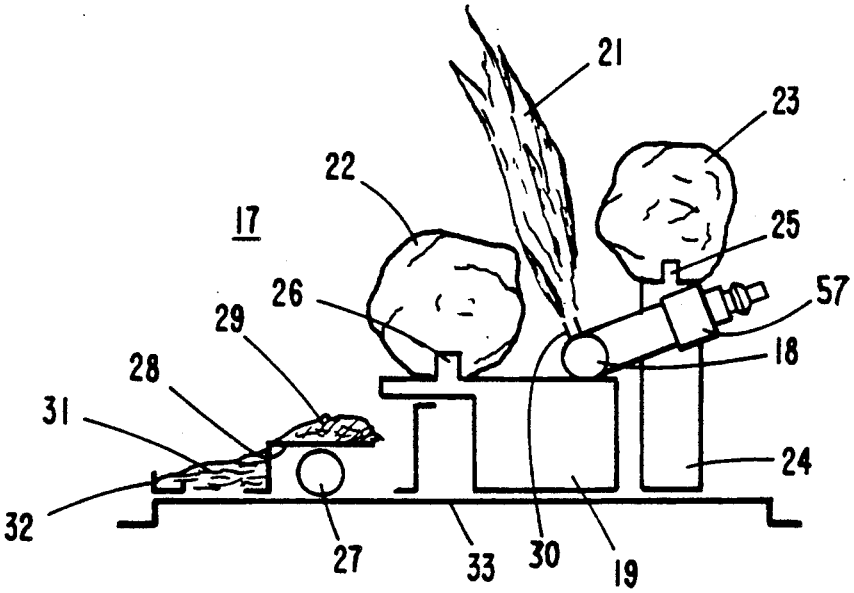
FIG. 2 is a schematic drawing in cross-section of a combination clean burning gas log system and a clean burning gas glowing ember system of the type employed in the present invention.

Refer now to FIG. 2 showing a schematic drawing and cross-section of a combination clean burning gas log system combined with a clean burning gas ember system of the type employed in the present invention to be explained in more detail hereinafter. Integrated burner systems 17 is provided with a first branch shown as burner pipe 18 supported on prefabricated grate 19 and constructed so as to emit a long yellow or orange flame 21 between the front log 22 and the rear log 23 of the decorative log burner system. The prefabricated grate 19 comprises a vertical support 24 which may be integrated with the grate 19 or constructed as a stand alone system for supporting the rear log 23 on guide pins 25. Guide pins 25 and 26 assure that the decorative logs 22 and 23 mounted thereon are in an exact and predetermined position so as to permit the flame 21 to pass between the logs without impinging thereon. As explained in our U.S. Pat. No. 4,875,464 directing and guiding the flame 21 away from impinging on logs 22 and 23 results in a clean burning efficient flame which passes all present ANSI and AGA standards.

The integrated burner system 17 further comprises a second burner pipe branch 27 shown shielded by a metal mesh screen 28 which is preferably disposed slightly above the branch 27 so as to permit a thorough mixing of air and gas before combustion takes place within the expanded glow material 29 supported on the metal mesh screen 28. Mounted in front of screen 28 and in front of branch 27 there is provided a fire resistant material which forms an opaque and decorative barrier 31. Such material may be in solid form or may be granular and held in place by a retainer 32.

The integrated burner system 17 is prefabricated in a factory environment where it may be tested and is mounted on a base support 33 where it is ready for installation into prefabricated fireplaces, or preexisting masonry fireplaces as will now be explained.

Figure 3:
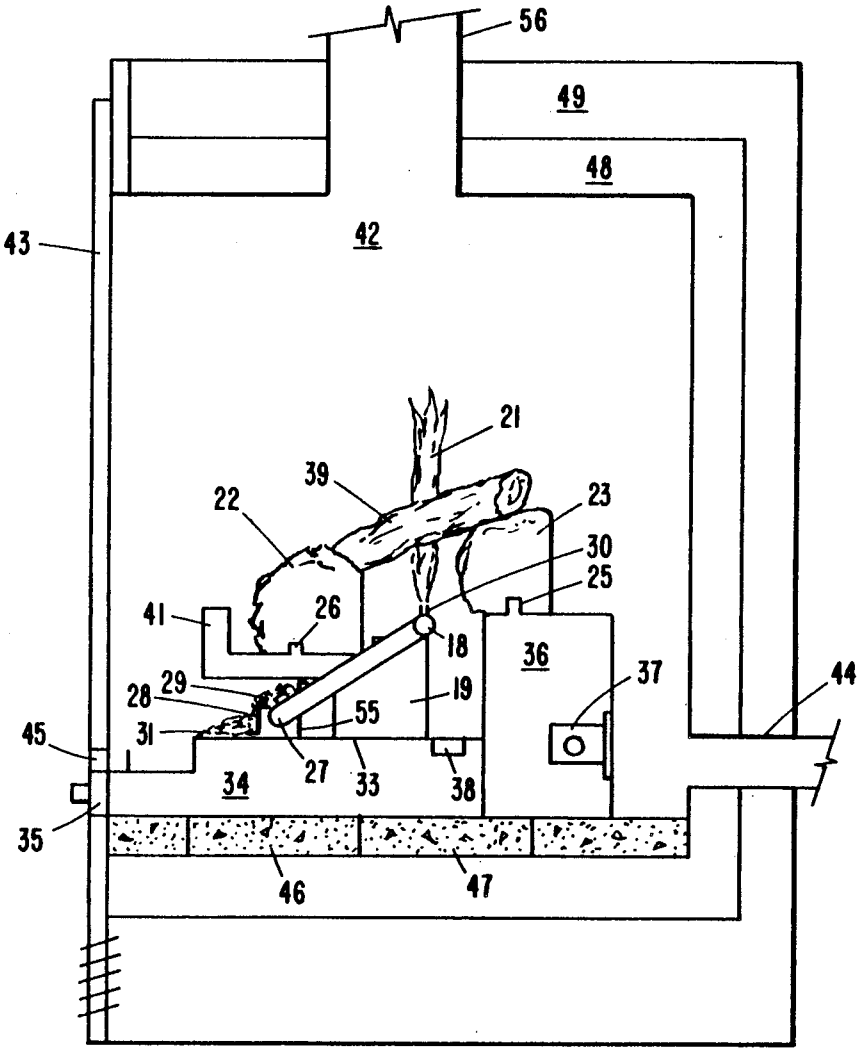
FIG. 3 is a schematic drawing in cross-section of a clean burning gas log system and clean burning gas ember system installed as a unit in a prefabricated sheet metal gas fireplace.

Refer now to FIG. 3 showing an integrated clean burning gas log system and a clean burning gas ember system of the type which is built into a prefabricated sheet metal fireplace 42. Support 33 is shown forming the top wall of a heat exchanger plenum 34 which has an inlet 35 for room air in one side of the plenum 34 and an exhaust outlet in the same plenum 34 which will be explained hereinafter. The rear of the heat exchanger 34 is provided with a vertical enlargement 36 of the plenum 34 in which the gas valve 37 is preferably mounted. A thermostat 38 is mounted to the hot base support 33 and electrically connected to the electric motor of the blower system which will be explained hereinafter. Guide pins 25 and 26 support prefabricated decorative logs 23 and 22, shown as transverse logs, which support cross logs 39 as will be explained hereinafter. The flame 21 from the first burner pipe branch 18 is formed by nozzle extensions 30 so as to pass through the opening between transverse logs 22 and 23 and intermittently between the cross logs 39 so as not to impinge thereupon. By separating the transverse logs 22 and 23 a critical and sufficient amount it is possible to generate a long decorative yellow and orange flame 21 which does not touch the logs 22, 23 and 39 that would act as a heat sink.

Grate 19 is shown having frontal and vertical extension pieces 41 which act as decorative retainers for the logs 22. The second burner pipe branch 27 of the integrated system 17 is shown having heated glow material 29 supported by a metal mesh 28 and shielded from view by ceramic material 31. The total burner system 17 combined with the heat exchanger 34, 36 may be placed as an integral unit inside of a prefabricated fireplace 42 of the type having either opening or closed fixed glass doors 43. Such fireplaces 42 may be designed so that the air burned by the integrated burner system is brought in through an outside air duct 44 or inside room air may be introduced through a slit or opening 45 provided below the glass doors 43. The integrated burner system is not dependent upon the source of fresh air to be burned. Prefabricated fireplace 42 is shown provided with a fire resistant refractory base material 46 supported on the floor 47 of the fireplace 42. Such fireplaces 42 may be further provided with dead air space chambers 48 and circulating (or heating) chambers 49 so that the fireplaces 42 may be installed as a zero clearance unit or free standing unit.

Figure 4:
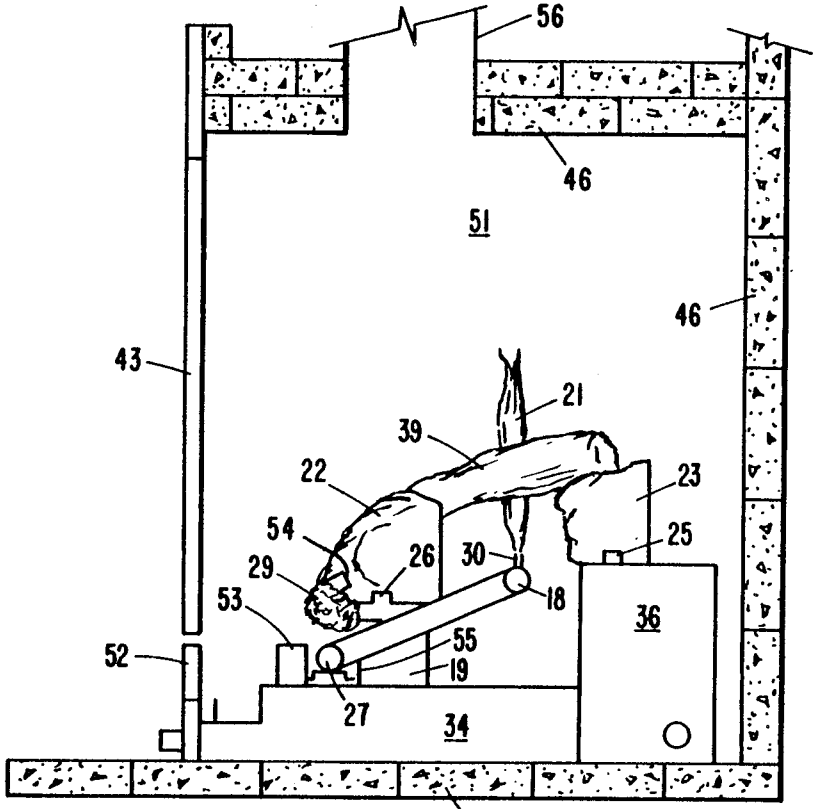
FIG. 4 is a schematic drawing in cross-section of another clean burning gas log system of another clean burning gas log system and clean burning gas ember system installed as a unit in a preexisting masonry fireplace.

Refer now to FIG. 4 showing a schematic drawing and cross-section of the preferred embodiment clean burning gas log system integrated with a clean burning gas ember system installed in a preexisting masonry fireplace 51. The integrated burner system 17 is substantially identical to the system 17 shown in FIG. 2 and those elements numbered the same are identical thereto and will not be explained again in detail, however, there are modifications. The second burner pipe branch 27 is moved further to the front of the glass doors 43 and an opaque decorative trim 52 is placed at the bottom of the doors 43. A metal trim piece or refractory material piece 53 is provided in front of the second burner pipe branch 27 so that it is not easily viewed by a person standing in front of the fireplace 51. A retainer slot 54 or other retainer means is provided in or on the transverse decorative log 22 so as to support the aforementioned glow material 29 which is mounted juxtaposed and directly above the second burner pipe branch 27 In this modification of the FIG. 2 embodiment the heated glow material appears to form a part of the log 22 giving the log a glowing ember effect instead of or in addition to surrounding glowing embers. A highly polished and mirror reflective shield 55 is shown behind and adjacent to the burner branch 27 so as to form an extension of the glow region under the logs. The fire brick 46 of the preexisting masonry fireplace 51 is provided with an outlet chimney 56 of known type. The glow material 29 to be heated is preferably attached to the integrated burner system 17 at the site of installation and provides means for providing either glowing embers and/or glowing logs as part of the integrated burner system 17.

Figure 5:
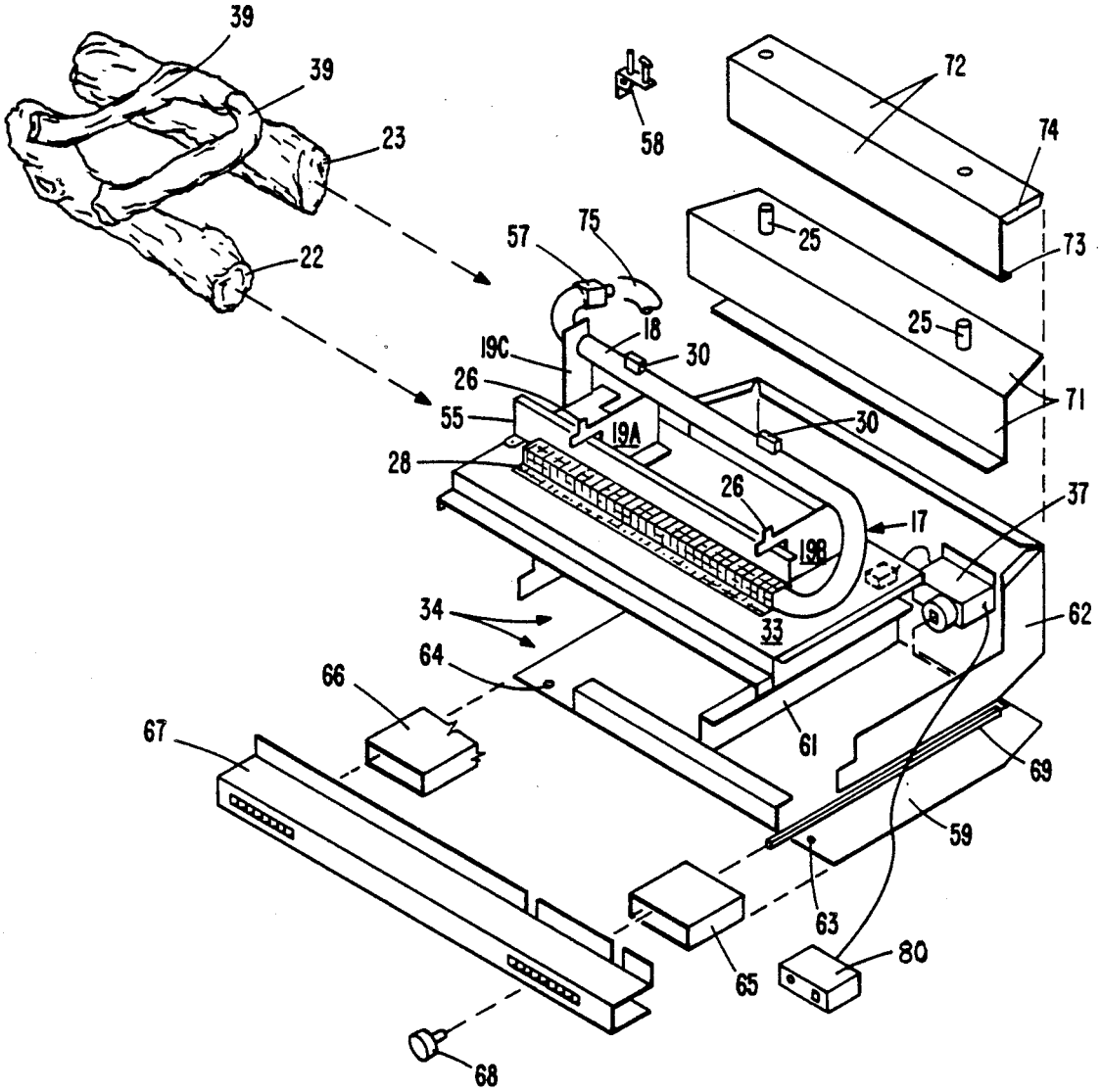
FIG. 5 is a more detailed isometric drawing of the preferred embodiment clean burning gas log and gas ember system for fireplaces having a high efficiency heat exchanger in the base support.

Refer now to FIG. 5 showing a detailed exploded isometric drawing of a preferred embodiment burner system 17 having a gas log burner and a gas ember burner built into and integrated with a high efficiency heat exchanger base which may be inserted as a unit in a prefabricated fireplace of the type shown in FIG. 3 or a preexisting masonry fireplace of the type shown in FIG. 4. The integrated burner system 17 is of the type shown in FIG. 3 having a Z shaped mesh screen 28 mounted on the base support 33. Also supported on base 33 is a prefabricated grate 19 comprising two vertical side pieces 19A and 19B. Grate 19 further includes a support 19C for supporting the first burner pipe branch 18 shown having nozzle extensions 30 and an inlet adapter 57 which is positioned over a pilot thermo generator 58 also mounted on base 33.

The heat exchanger 34 is shown comprising a bottom plate 59 having a vertical baffle 61 which supports the top wall and platform 33 of the heat exchanger 34. The three sided folded metal part 62 connects to the bottom plate 59 and top wall 33 which forms a substantially closed plenum having an inlet area 63 and an exhaust or outlet area 64 through which ducts 65 and 66 extend and are mounted. As will be explained hereinafter duct 66 connects directly to the housing which surrounds the blower of the motor (not shown) which circulates room air through the heat exchanger. A shroud or decorative piece 67 extends over the ducts 65 and 66 and forms a transverse piece below the glass doors 43 and or the decorative trim piece 52 as the case may be. A control knob 68 for controlling the amount of gas supplied to the burner system 17 extends through the shroud or trim piece 67 and connects to a control rod 69 which in turn connects to the gas valve 37 mounted on the rear vertical wall of the plenum 34. A Z shaped plate 71 forms part of the vertical enlargement of the heat exchanger and attaches to the rear vertical wall part 62 and to the rear edge of base support 33. An L shaped member 72 is provided with turned edges 73 and 74 which act as spacer means for part 72 when slipped over the pins 25 on part 71 to form dead air chambers therebetween.

Adapter 57 comprises an air shutter or ventura through which gas is supplied to the burner system 17. A flexible pipe 75 is shown connected to ventura 57 and connects to the gas valve 37 which is controlled by the control knob 68 and control rod 69 to control the height of the flame and the burner system 17. Mounting pins 25 and 26 fit into recesses in the transverse logs 22 and 23. The transverse logs 22 and 23 are provided with either pins or recesses which cooperate with either recesses or pins in the cross logs 39 for exactly and precisely positioning the decorative log system 22, 23, 39 on the grate 19 of the burner system 17.

Figure 6:
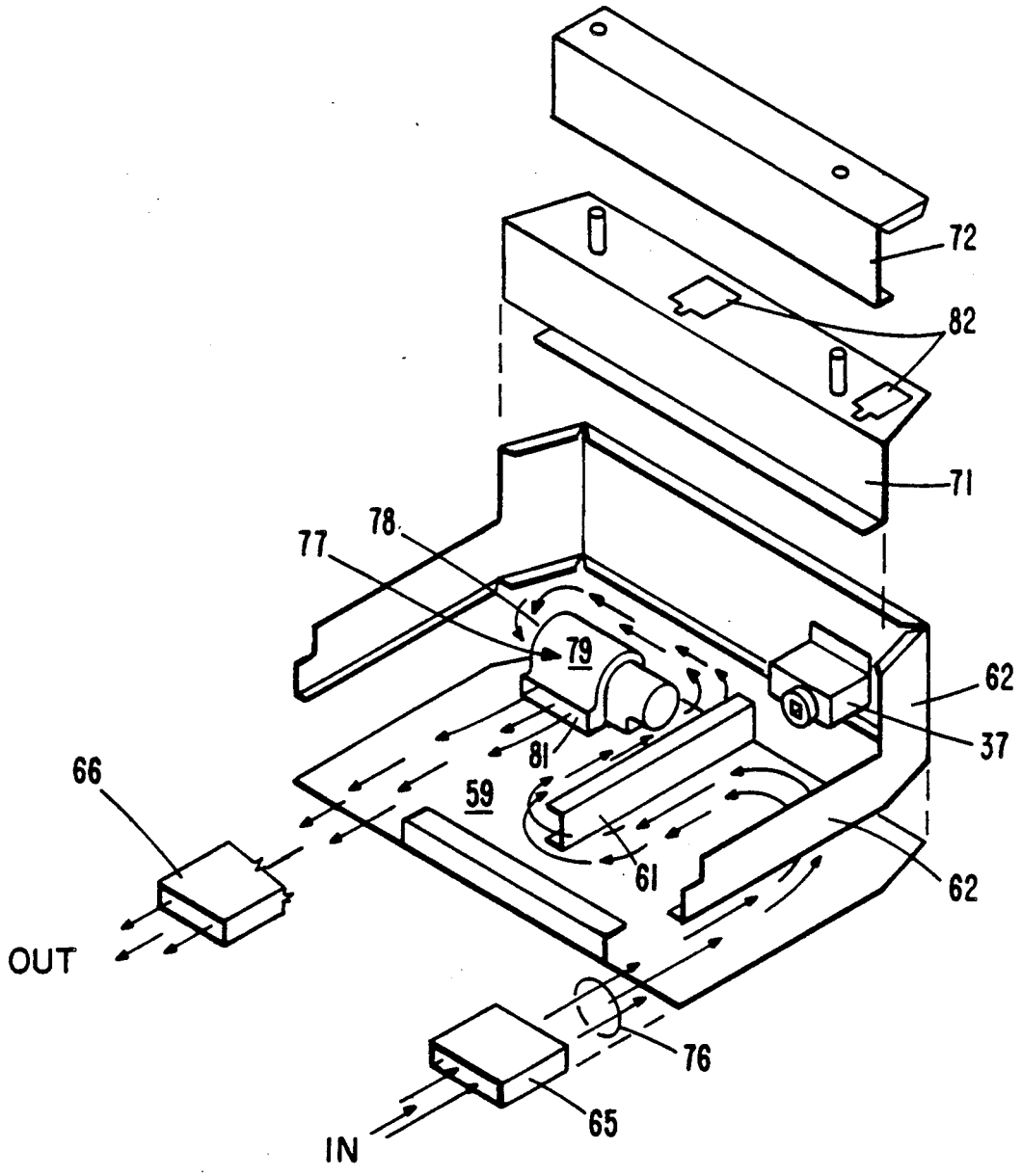
FIG. 6 is an isometric drawing of a portion of the heat exchanger system shown in FIG. 5 showing the blower system.

Refer now to FIG. 6 showing an isometric drawing of a portion of the lower plenum system of the heat exchanger shown in FIG. 5. The bottom plate 59 is shown having the Z shaped vertical baffle 61 mounted thereon which forms a partition for diverting the inlet air path 76 past the gas valve 37 and into the portion of the heat exchanger 34 in which the blower system 77 is mounted on the bottom plate 59. The inlet 78 of the blower housing 79 is at the end of the housing and has an outlet 81 which physically connects to the outlet duct 66. It will be noted that the inlet duct 65 terminates a short distance inside of the heat exchanger 34 so to form a closed plenum having only an inlet 65 and an outlet 66. As explained hereinbefore the base support 33 forms a hot plate for transmitting heat from the burner system into the heat exchanger and the blower system 77 forms the means for removing the hot air from the heat exchanger. In some forms of prefabricated fireplaces like FIG. 2, a blower system is already provided and the lower part of the plenum system 34 may be completely eliminated and just the glowing ember and burner system 17 mounted on plate 33 is installed in such a prefabricated fireplace.

When the heat exchanger system shown in FIG. 6 is employed, the Z shaped plate 71 of the plenum system 34 is provided with one or more cooling holes 82 preferably located over the gas valve 37 and thermostat controlled electric motor portion of blower system 77 so as to maintain a circulating cool air through inlet 65 when the blower system 77 is disengaged or not operating.

In the preferred embodiment of the present invention thermostatically controlled flap valves need not be mounted over the cooling holes 82 when the L shaped member 72 is properly spaced above the cooling holes 82 so as to form a back resistance when the blower system 77 is operational. Stated differently blower system 77 is designed so that it will not draw smoke and combustion gases from the combustion chamber into the heat exchanger and blow them into the room area through outlet duct 66. The means shown for preventing this combustion gas from mixing with the heated air does not comprise the only usable structure but may include other means such as thermostatic dampers. The blower motor and/or the gas valve 37 are preferably connected to a remote sensor 80 shown for remote control operation.

Figure 7:
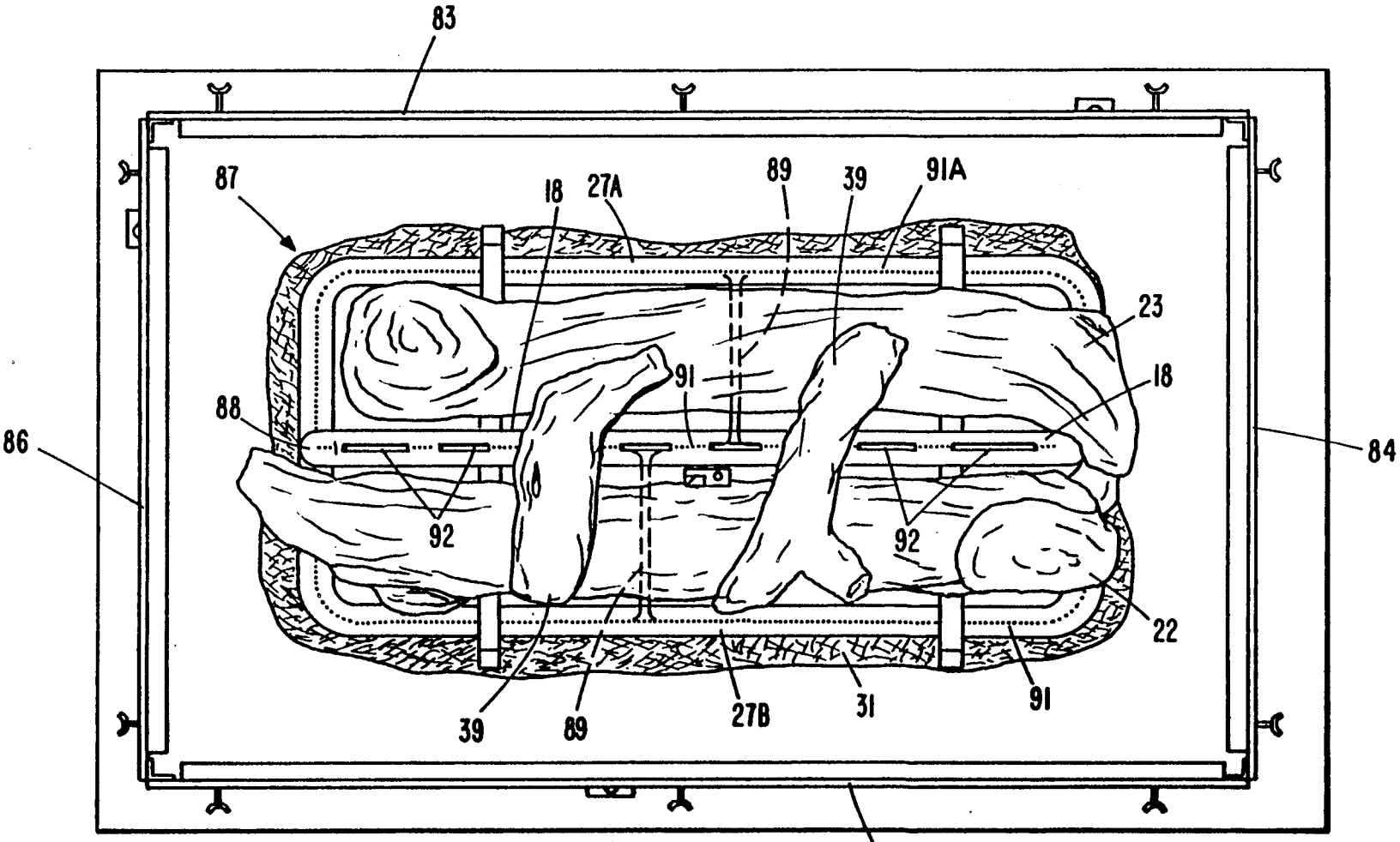
FIG. 7 is a schematic drawing in cross-section of a gas log burner system showing burner nozzle slots and burner migration holes for a glowing ember system on four sides.

Refer now to FIG. 7 showing a plan view of an integrated glowing ember and gas burner system for use with a fireplace of the type known as multiside glass fireplace systems. Such a universal fireplace system is shown in our patent 4,852,548 and may include one to four glass sides. The novel integrated burner system 87 may have an inlet gas pipe 88 at either or both ends of the system. The main branch pipe 18 is shown extending through the center of logs 22 and 23 which provide an opening therebetween for the decorative flames explained hereinbefore. The secondary burner pipe branches 27A and 27B are shown uncovered with the glow material removed so that the preferred burner holes may be explained in detail. Surrounding the burner pipe branches 27A and 28A is the fire resistant material 31 explained hereinbefore which forms a decorative mask or support for the burner branches 27A and 27B which totally surround the decorative log system 22, 23, 39. Burner pipe branch 27A is shown having a plurality of apertures therein which comprise flame migration holes that also may act as the decorative ember flame holes 91A which provide the flame for the heated glow material made from an expanded light weight fire resistant material such as spun glass or expanded mineral wool. It is more economical to punch the flame migration holes 91A in the pipe branch 27A as a single series of holes in a pipe or thin wall tube than to provide parallel and multiple flame migration holes and separate decorative ember flame holes It is sometimes desirable to provide the integrated burner system 17 with lighting tubes 89 than to punch the flame migration holes around the entire burner system when there is no glass wall on an end or side of the fireplace and no ember system.

The preferred embodiment first burner pipe system 18 is shown provided with flame migration holes 91 as well as decorative flame ports 92. Preferred embodiment decorative flame ports are shown as elongated slots which are preferably cut in the pipe material 18 using a laser cutter or plasma cutting tool so as to form precise openings with exact and sharp edges forming nozzles without extensions 30 for directing the gas through the openings between logs 22 and 23 without impinging thereon. Using a plasma cutting tool or laser cutting tool no internal female die structure need be inserted in the pipe for a punching operation which deforms the pipe 18. The slag formed by such cutting tools may be blown out or removed by gravity before closing the ends of the tube.

Having explained the preferred embodiment migration holes 91 and flame ports 92 formed preferably as slots, it will be understood that the burner pipes 27A, 27B and 18 may be formed employing a punching operation using holes of the type shown and described in our U.S. Pat. No. 4,875,464. It has been found that it is more economical to punch the flame migration holes 91 for the glowing embers and to plasma machine or laser cut the decorative flame ports or slots 92 in the primary burner tube 18 which act as nozzles.

Having explained a fireplace system in FIG. 7 having four glass sides, it will now be understood that any fireplace system may utilize the present embodiment invention having one to four glass sides and glowing embers along the front of the side where the glass is used. The glowing embers may be formed as a base of ash below the decorative logs 22, 23 or may be formed at the base of the logs themselves as explained hereinbefore with reference to FIG. 4. Thus, having explained the preferred embodiment of the present invention any combination of burner systems 17 may be designed to economically accommodate fireplaces having singular or multiglass sides or for fireplace systems already having their own heat exchanger systems or fireplace systems which require heat exchanger systems.

What is claimed is:

1. A glowing ember gas log burner system for decorative gas logs, comprising;

decorative gas logs comprising an arrangement of logs having openings between logs to permit gas flames to escape therethrough;

gas burner means having a plurality of burner pipe branches, at least one of said burner pipe branches being mounted below said decorative gas logs at the openings between logs, said burner pipe branch mounted below said decorative gas logs having a plurality of decorative flame ports and a plurality of flame migration apertures between said flame ports, said flame migration apertures being spaced such that the gas flame is carried from one flame port to another, said decorative flame ports providing nozzle means for directing decorative flames through the openings between said decorative gas logs without the flames impinging upon the logs in a manner which would cool the decorative flames, at least one other burner pipe branch being arranged in front of said decorative gas logs and having a plurality of decorative ember flame holes, glow material arranged juxtaposed said decorative ember flame holes for producing glowing decorative ember flames in front of said decorative gas logs whereby said glowing ember flames contain low carbon monoxide, and platform support means for supporting said decorative gas logs, said gas burner means and said glow material in a fixed predetermined position relative to each other.

2. A glowing ember gas log burner system as set forth in claim 1 wherein said glow material comprises an expanded light weight fireproof material.

3. A glowing ember gas log burner system as set forth in claim 2 which further includes means for supporting said expanded light weight fireproof material directly over said decorative ember flame holes.

4. A glowing ember gas log burner system as set forth in claim 3 wherein said means for supporting said expanded light weight fireproof material comprises a metal screen.

5. A glowing ember gas log burner system as set forth in claim 3 wherein said means for supporting said expanded light weight fireproof material comprises means for attaching said glow material on the front of said decorative gas logs.

6. A glowing ember gas log burner system as set forth in claim 3 wherein said means for attaching said expanded light weight glow material comprises recesses on the front of said decorative gas logs.

7. A glowing ember gas log burner system as forth in claim 1 wherein said glow material comprises an expanded light weight mineral wool.

8. A glowing ember gas log burner system as set forth in claim 1 wherein said glow material comprises an expanded light weight fiber glass.

9. A glowing ember gas log burner system as set forth in claim 1 wherein said nozzle means for directing decorative flames comprises laser cut slots with sharp edges in said burner pipe branch.

10. A glowing ember gas log burner system as set forth in claim 1 wherein said nozzle means for directing decorative flames comprises plasma cut slots with sharp edges in said burner pipe branch.

11. A glowing ember gas log burner system as set forth in claim 1 wherein said platform support means comprises a formed metal sheet having two vertical plain side-supports and one vertical plain rear support.

12. A glowing ember gas log burner system as set forth in claim 1 wherein said platform support means comprises a horizontal base member of a combustion chamber which is connected to and forms the top of a heat exchanger.

13. A glowing ember gas log burner system as set forth in claim 12 which further includes a blower system having an electric motor mounted inside of said heat exchanger, and an exhaust duct connected between said blower system and an outside wall of said heat exchanger.

14. A glowing ember gas log burner system as set forth in claim 13 which further includes an inlet duct connected through an outside wall of said heat exchanger for introducing cold air into said heat exchanger.

15. A glowing ember gas log burner system as set forth in claim 14 which further includes baffle support means inside of said heat exchanger.

16. A glowing ember gas log burner system as set forth in claim 14 which further includes a gas control valve mounted inside of said heat exchanger in the path of the cold air introduced through said inlet duct.

17. A glowing ember gas log burner system as set forth in claim 16 which further includes a cover plate covering said gas control valve and forming a vertical extension of said heat exchanger.

18. A glowing ember gas log burner system as set forth in claim 17 wherein said cover plate is provided with cooling holes for cooling said electric motor when said blower system is inoperable.

19. A glowing ember gas log burner system as set forth in claim 1 which further includes a remote control sensor, and a gas valve electrically coupled to said remote control sensor and physically connected to said gas burner means for providing remote on-off control of the gas being supplied to said burner branches.

20. A glowing ember gas log burner system as set forth in claim 1 wherein said decorative flame ports comprise extension nozzles for directing flames through the openings between said decorative gas logs.

* * * * *